US007484502B1

(12) United States Patent
Yoon

(10) Patent No.: US 7,484,502 B1
(45) Date of Patent: Feb. 3, 2009

(54) EGR COOLANT CONTROL SYSTEM

(75) Inventor: Sung Il Yoon, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 11/966,116

(22) Filed: Dec. 28, 2007

(30) Foreign Application Priority Data

Aug. 24, 2007 (KR) ..... 10-2007-0085719

(51) Int. Cl.
*F02B 47/08* (2006.01)
*F02B 47/10* (2006.01)

(52) U.S. Cl. ..... 123/568.12

(58) Field of Classification Search ..... 123/568.12, 123/568.11, 41.08
See application file for complete search history.

(56) References Cited

U.S. PATENT DOCUMENTS 7,299,771 B2 * 11/2007 Wei et al. ..... 123/41.08
2003/0070427 A1 * 4/2003 Banzhaf et al. ..... 60/320
2004/0216700 A1 * 11/2004 Hutchins ..... 123/41.08
2006/0185626 A1 * 8/2006 Allen et al. ..... 123/41.12
2007/0028902 A1 * 2/2007 Nigoro et al. ..... 123/568.12

* cited by examiner

*Primary Examiner*—Mahmoud Gimie
(74) *Attorney, Agent, or Firm*—Morgan, Lewis & Bockius LLP

(57) ABSTRACT

An EGR coolant control system according to an exemplary embodiment of the present invention may include a coolant exhaust pipe connected with the coolant supply pipe, an EGR coolant supply pipe connected with the coolant supply pipe and the coolant exhaust pipe, a coolant control plate that is disposed in a junction portion of the coolant supply pipe, the coolant exhaust pipe, and the EGR coolant supply pipe, and that controls supply of a coolant, and an actuator controlling the coolant control plate according to in engine rotation speed.

5 Claims, 5 Drawing Sheets

EGR COOLANT CONTROL SYSTEM

CROSS-REFERENCE TO RELATED APPLICATION

This application claims priority to and the benefit of Korean Patent Application No. 10-2007-0085719 filed in the Korean Intellectual Property Office on Aug. 24, 2007, the entire contents of which are incorporated herein by reference.

BACKGROUND OF THE INVENTION (a) Field of the Invention

The present invention relates an EGR coolant control system. More particularly, the present invention relates to an EGR coolant control system that may control a flow of coolant which is supplied to an EGR cooling apparatus, an oil cooler, and so on, so that cooling efficiency may be enhanced.

(b) Description of the Related Art

An exhaust gas recirculation ("EGR") system is provided to a vehicle for reducing noxious exhaust gas.

Generally, NOx is increased in a case where an air ratio of an air-fuel mixture is high, which is necessary for sufficient combustion. Thus, the exhaust gas recirculation system mixes exhaust gas from an engine with the air-fuel mixture, for example at 5-40%, thereby reducing the amount of oxygen in the air-fuel mixture and retarding combustion, and so lessening generation of NOx.

Generally, the temperature of exhaust gas from an engine is very high, and so a cooling apparatus for cooling recirculation exhaust gas is provided therewith.

An oil cooler, a radiator, and so on need cooling in an operation of a vehicle, and, generally, the flow rate of the required coolant for cooling is increased in proportion to rotation speed of an engine.

The coolant flow rate for cooling the EGR cooling apparatus, the oil cooler, and so on is supplied in proportion to rotation speed of an engine.

As shown in FIG. 1, as the coolant rate is increased, the slope of EGR cooler efficiency is gradually decreased.

That is, when the coolant is simultaneously supplied to the EGR cooling apparatus and the oil cooler in proportion to rotation speed of an engine, the coolant is excessively supplied to the EGR cooling apparatus at a high speed and the coolant is insufficiently supplied to the oil cooler at a high speed. Thus, cooling efficiency is deteriorated.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an EGR coolant control system that may control an amount of a coolant that is supplied to an EGR cooling apparatus, an oil cooler, and so on according to an engine rotation speed.

An EGR cooling system according to exemplary embodiment of the present invention may reduce a required amount of coolant so that total weight of a vehicle may be reduced.

An EGR cooling system according to exemplary embodiment of the present invention may include a coolant exhaust pipe connected with a coolant supply pipe, an EGR coolant supply pipe connected with the coolant supply pipe and the coolant exhaust pipe, a coolant control plate that is disposed in a junction portion of the coolant supply pipe, the coolant exhaust pipe, and the EGR coolant supply pipe, wherein the coolant control plate controls supply of a coolant, and an actuator controls the coolant control plate according to an engine rotation speed.

The actuator may include a body, a pressure supply pipe for supplying pressure to the body, a diaphragm disposed at one side of the body, and an elastic member for supporting the diaphragm.

The pressure supply pipe may be connected with an intake manifold, and receives back pressure of the intake manifold.

The pressure supply pipe is connected with an exhaust manifold and receives back pressure of the exhaust manifold.

The pressure supply pipe is connected with a input portion of the coolant supply pipe and receives a partial pressure of the coolant supply pipe.

An EGR cooling system according to exemplary embodiment of the present invention may control an amount of a coolant that is supplied to an EGR cooling apparatus, an oil cooler, and so on according to an engine rotation speed.

An EGR cooling system according to exemplary embodiment of the present invention may reduce a maximum required amount of a coolant so that total weight of a vehicle may be reduced.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

DESCRIPTION OF REFERENCE NUMERALS INDICATING PRIMARY ELEMENTS IN THE DRAWINGS

Figure 1:
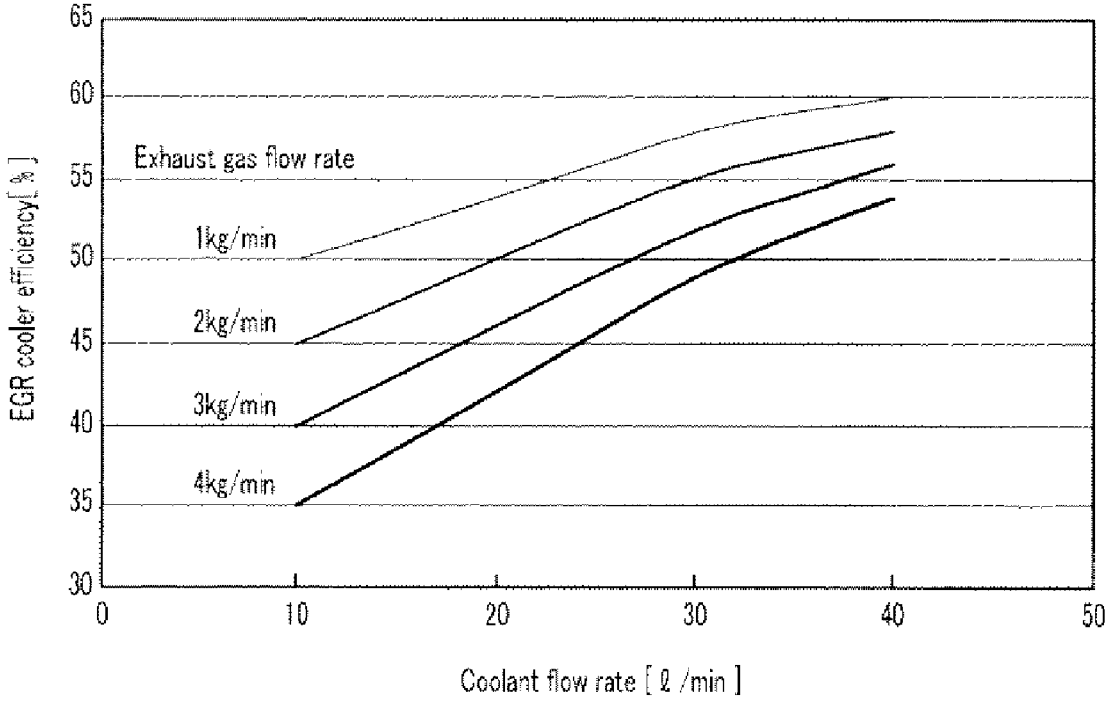
FIG. 1 is a schematic graph showing cooling efficiency according to an EGR coolant flow rate.

100: coolant control portion
110: coolant supply pipe
120: coolant exhaust pipe
130: EGR coolant supply pipe
200: actuator
210: pressure supply pipe
220: body
230: diaphragm
240: elastic member
250: rod
260: rotating shaft

270: coolant connection pipe
280: exhaust manifold
290: intake manifold
300: coolant control plate It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Embodiments of the present invention will hereinafter be described in detail with reference to the accompanying drawings.

Figure 2:
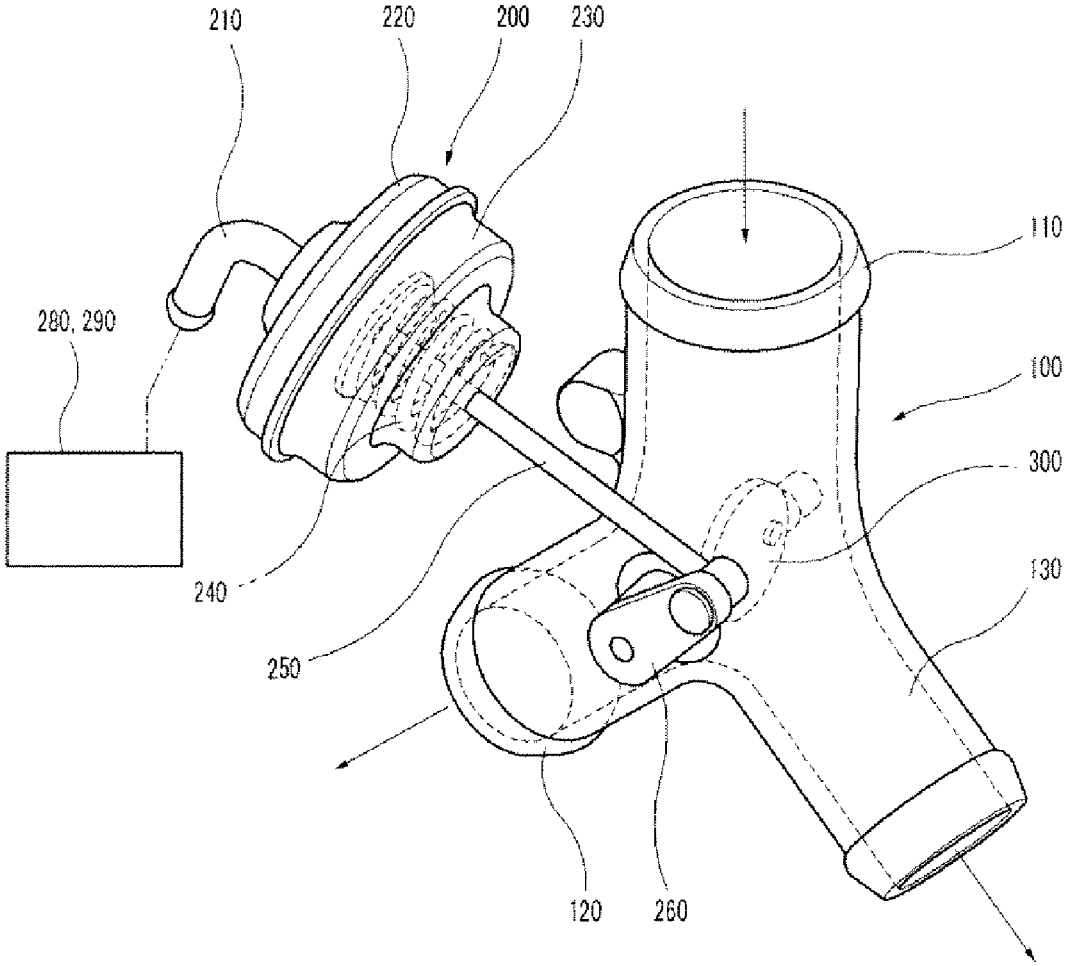
FIG. 2 is a perspective view of an EGR coolant control system according to an exemplary embodiment of the present invention.

FIG. 2 is a perspective view of an EGR coolant control system according to an exemplary embodiment of the present invention.

Referring to FIG. 2, an EGR coolant control system according to an exemplary embodiment of the present invention includes a coolant control portion 100 and an actuator 200.

The coolant control portion 100 includes a coolant supply pipe 110, a coolant exhaust pipe 120 connected with the coolant supply pipe 110, and an EGR coolant supply pipe 130 connected with the coolant supply pipe 110 and the coolant exhaust pipe 120. That is, the coolant exhaust pipe 120 and an EGR coolant supply pipe 130 are branched from the coolant supply pipe 110 in common.

The coolant exhaust pipe 120 supplies a coolant to an oil cooler (not shown) or so on, and the EGR coolant supply pipe 130 supplies a coolant to an EGR cooling apparatus (not shown).

A coolant control plate 300 is disposed at a junction of the coolant supply pipe 110, the coolant exhaust pipe 120 and the EGR coolant supply pipe 130 in the coolant control portion 100 for control of coolant supply to the coolant exhaust pipe 120 and the EGR coolant supply pipe 130.

The actuator 200 is connected to the coolant control plate 300 for controlling rotational movement of the coolant control plate 300 according to rotation speed of an engine (not shown).

The actuator 200 includes a body 220, a pressure supply pipe 210 for supplying a pressure to the body 220, a diaphragm 230 disposed at and enclosing the other side of the body 220 to fluidly communicate with the pressure supply pipe 210, and an elastic member 240 disposed between the body 220 and the diaphragm 230 for supporting the diaphragm 230, a rod 250 wherein one end of rod 250 is connected to the diaphragm 230 and the other end of the rod 250 hingedly controls the rotation of the coolant control plate 300. Both ends of the elastic member 240 may be coupled to the body 220 and the diaphragm 230 respectively.

In detail, the diaphragm 230 is connected to a proximate end of a rod 250 and a distal end of the rod 250 is hingedly connected to a proximate end of rotating shaft 260. The proximate end of the rotating shaft 260 pivotally rotates with respect to a distal end of the rotating shaft 260. Furthermore, the distal end of the rotating shaft 260 is pivotally connected to a portion of the coolant control plate 300.

Figure 3:
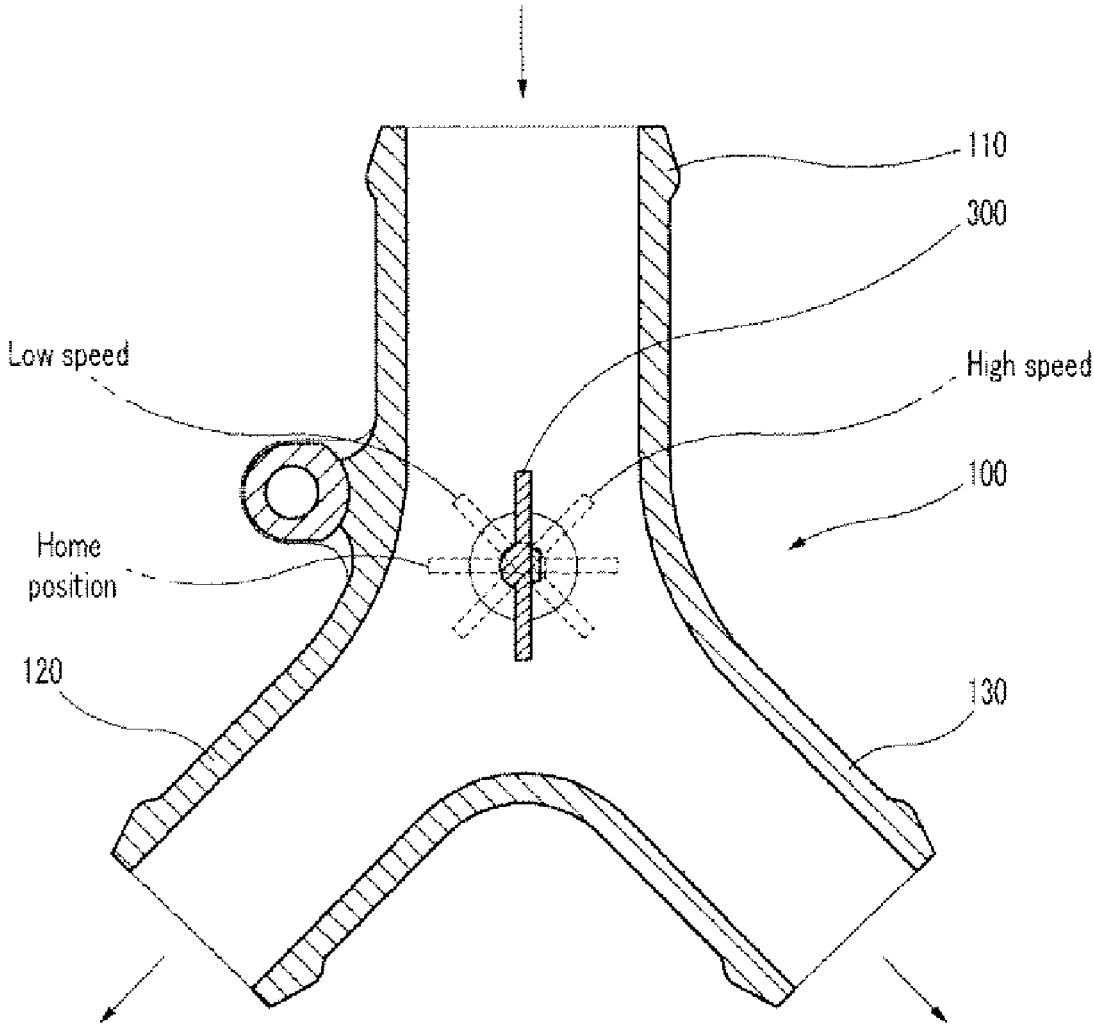
FIG. 3 is a drawing showing an operation of the EGR coolant control system according to an exemplary embodiment of the present invention.

FIG. 3 is a cross-sectional view showing an operation of the EGR coolant control system according to an exemplary embodiment of the present invention.

As shown in FIG. 3, the coolant control plate 300 is controlled according to a rotation speed of an engine, and an amount of coolant supply to the coolant exhaust pipe 120 and the EGR coolant supply pipe 130 is controlled by operation of the coolant control plate 300.

Hereinafter, an operation of the actuator will be explained.

An exemplary embodiment in which the pressure supply pipe 210 is connected with an exhaust manifold 280 will be explained.

Normally, the coolant control plate 300 is positioned at the home position when the rotation speed of an engine (not shown) is zero.

When the rotation speed of an engine (not shown) is increased to a high speed and thus pressure applied to the diaphragm 230 of the actuator 200 is increased, the diaphragm 230 pushes the rod 250 to the right direction and the elastic member 240 extends as shown in FIG. 3. Accordingly the coolant control plate 300 rotates clockwise from the home position in this embodiment.

As a result, the coolant amount supplied to the coolant exhaust pipe 120 becomes larger than the coolant amount supplied to the EGR coolant supply pipe 130.

Therefore, the coolant exhaust pipe 120 supplies a relatively larger amount of coolant to the oil cooler (not shown) or a radiator (not shown) at a high engine speed, and thus cooling efficiency is increased.

in contrast, as the rotation speed of an engine (not shown) is decreased to a low speed and thus the pressure applied to the diaphragm 230 of the actuator 200 is decreased, the restoring force of the elastic member 240 pulls the rod 250 to the left direction as shovel in FIG. 3 and thus the coolant control plate 300 rotates counterclockwise toward the home position in this embodiment as shown in FIG. 3.

As a result, the amount of coolant supplied to the EGR coolant supply pipe 130 is larger than the amount of coolant supplied to the coolant exhaust pipe 120.

Therefore, the EGR coolant supply pipe 130 supplies a relatively larger amount of coolant to the EGR cooling apparatus (not shown) at a low engine speed, and thus cooling efficiency is increased.

An exemplary embodiment in which the pressure supply pipe 210 is connected with an intake manifold 290 will now be explained.

When a rotation speed of an engine (not shown) is increased, back pressure in the intake manifold 290 is increased. As the back pressure in the intake manifold 290 is increased, the diaphragm 230 pulls the rod 250 to the left direction and the elastic member 240 becomes compressed. Accordingly the coolant control plate 300 rotates counterclockwise from the home position.

In contrast, when a rotation speed of an engine (not shown) is decreased, back pressure in the intake manifold 290 is decreased. As the back pressure in the intake manifold 290 is decreased, the restoring force of the compressed elastic member 240 pushes the diaphragm 230 and the rod 250 to the right direction. Accordingly the coolant control plate 300 rotates clockwise from the home position.

In this case, positions of the coolant supply pipe 110 and the coolant exhaust pipe 120 are changed from side to side, opposite to the case in which the pressure supply pipe 210 is connected with an exhaust manifold 280.

Except for the positions of the coolant supply pipe 110 and the coolant exhaust pipe 120, the operation of the actuator 200 and controls of supplying coolants are the same.

Figure 4:
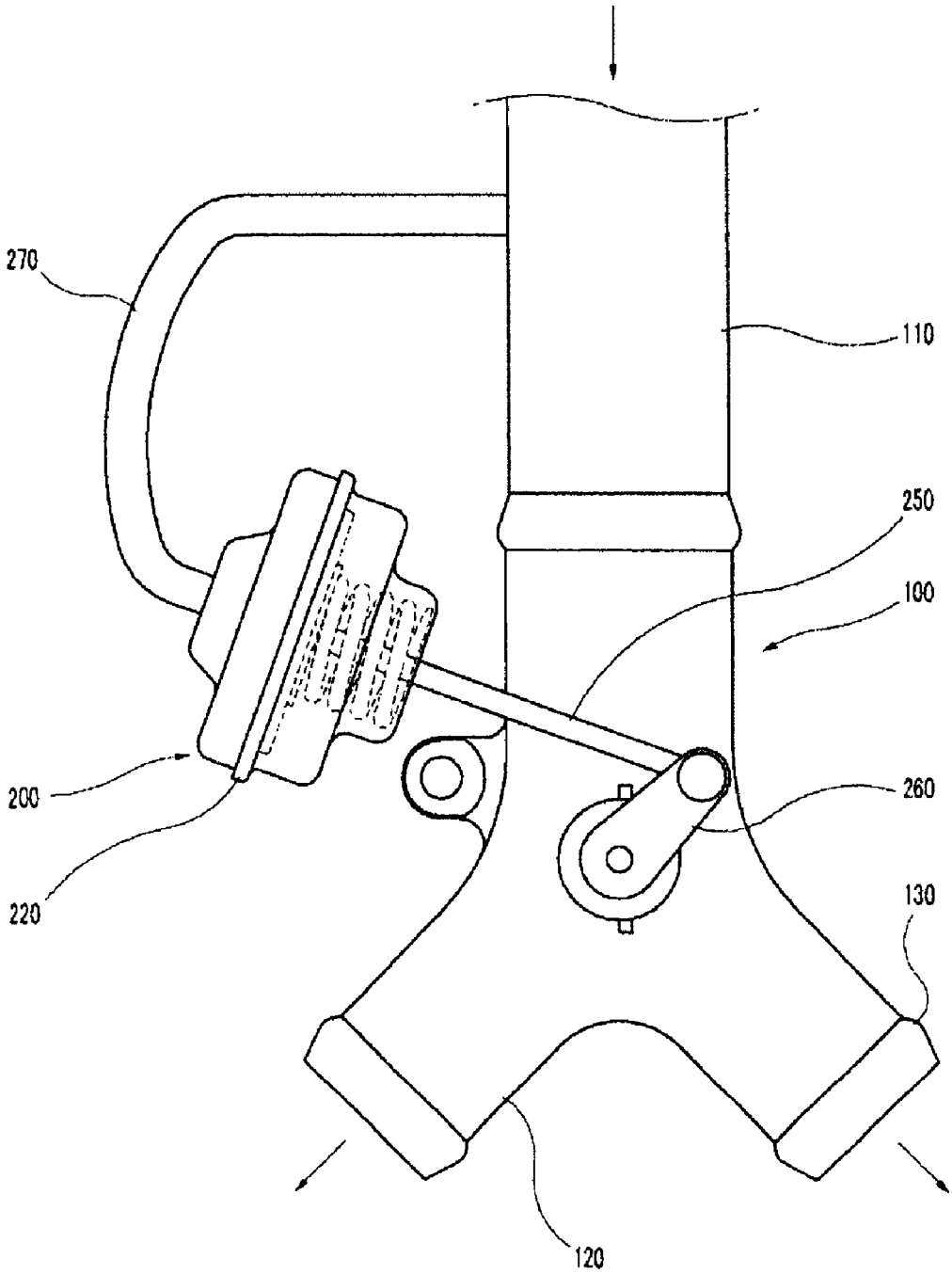
FIG. 4 is a front view of an EGR coolant control system according to another exemplary embodiment of the present invention.

FIG. 4 is a front view of an EGR coolant control system according to another exemplary embodiment of the present invention.

In the EGR coolant control system according to this exemplary embodiment of the present invention, a coolant connection pipe 270 is connected with the input portion of the coolant supply pipe 110.

The flow rate of the coolant is changed in proportion to the rotation speed of an engine. That is, if the rotation speed of an engine (not shown) is increased, the input pressure in the coolant supply pipe 110 is increased. Thus, an operation in the case in which the coolant connection pipe 270 is connected with the coolant supply pipe 110 is identical to the case that the pressure supply pipe 210 is connected with the exhaust manifold 280.

Excepting that the coolant connection pipe 270 is connected with the coolant supply pipe 110, the EGR coolant control system is operated the same as when the pressure supply pipe 210 is connected with the exhaust manifold 280, so a detailed description will be omitted.

Figure 5:
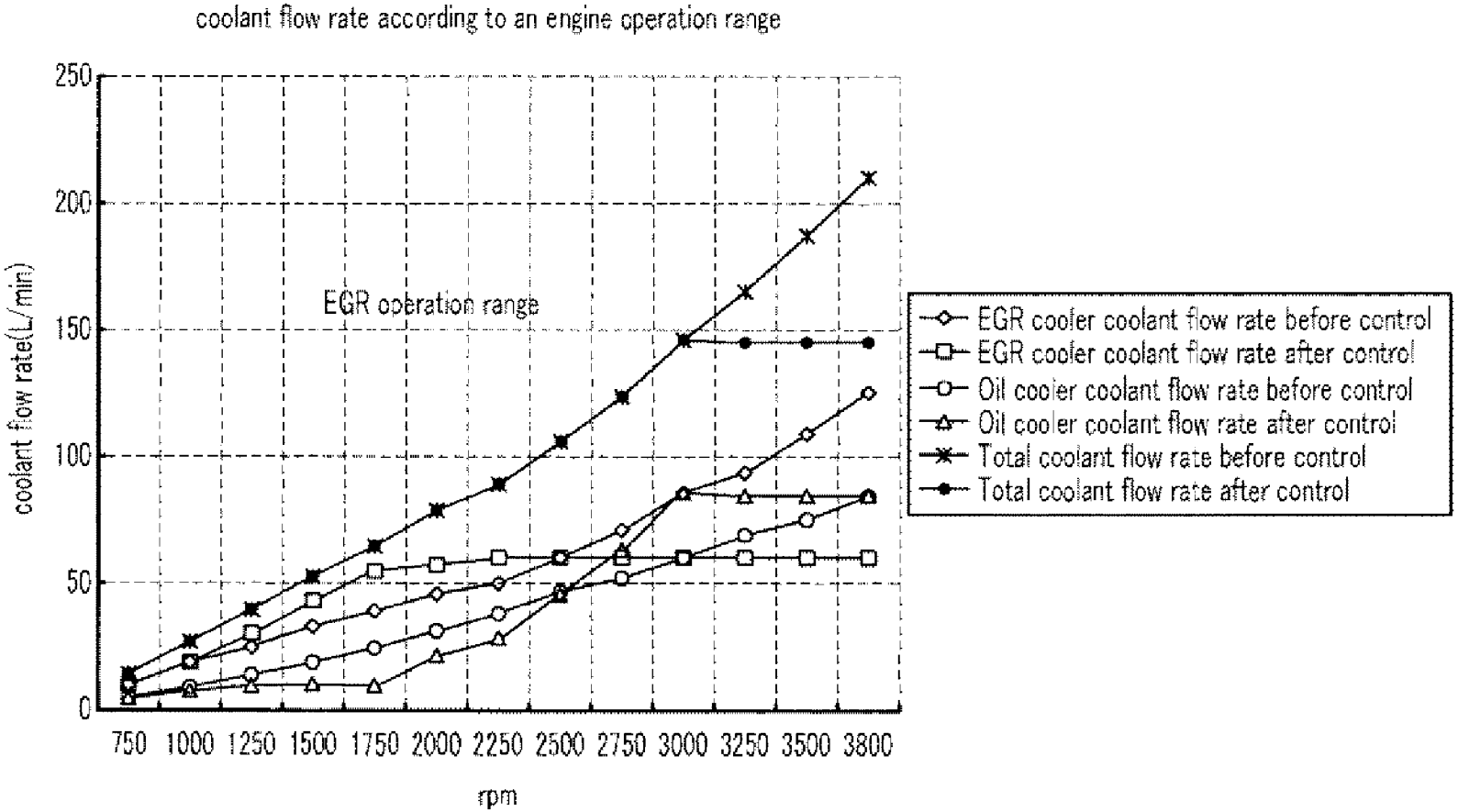
FIG. 5 is a schematic graph showing a coolant flow rate according to an engine operation range.

FIG. 5 is a schematic graph showing coolant flow rate according to engine operation range.

As shown in FIG. 5, when the EGR coolant control system according to an exemplary embodiment of the present invention is operated, the maximum coolant flow rate is reduced.

As described above, when the rotation speed of an engine is increased, the amount of coolant supplied to the oil cooler or the radiator becomes larger than the amount of coolant supplied to the EGR cooling apparatus. When the rotation speed of an engine is decreased, the amount of coolant supplied to the EGR cooling apparatus becomes larger than the amount of coolant supplied to the oil cooler or the radiator. Thus, cooling efficiency will be enhanced.

The EGR cooling system according to the exemplary embodiments of the present invention may reduce a maximum required amount of coolant so that the total weight of a vehicle may be reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An EGR coolant control system comprising:

a coolant supply pipe;

a coolant exhaust pipe wherein a proximate end portion of the coolant exhaust pipe is connected with a distal end portion of the coolant supply pipe;

an EGR coolant supply pipe wherein a proximate end portion of the EGR coolant supply pipe is connected with the distal end portion of the coolant supply pipe and the proximate end portion of the coolant exhaust pipe in common;

a coolant control plate that is pivotally disposed in a junction portion of the distal end portion of the coolant supply pipe, the proximate end portion of the coolant exhaust pipe and the proximate end portion of the EGR coolant supply pipe, and the coolant control plate controls supply of coolant to the coolant exhaust pipe or the EGR coolant supply pipe; and an actuator controlling the coolant control plate according to an engine rotation speed, wherein the actuator comprises:

a body;

a pressure supply pipe for supplying pressure to the body;

a diaphragm disposed at and enclosing one side of the body and fluidly communicating with the pressure supply pipe; and an elastic member disposed between the body and the diaphragm, wherein both ends of the elastic member are coupled to the body and the diaphragm respectively for supporting the diaphragm.

2. The EGR coolant control system of claim 1, further comprising:

a rod and a rotating shaft, wherein a proximate end of the rod is connected to a portion of the diaphragm and a distal end of the rod is pivotally connected to a proximate end of a rotating shaft and a distal end of the rotating shaft is connected hingedly to a portion of the coolant control plate; and wherein the proximate end of the rotating shaft is pivotally rotated with respect to the distal end of the rotating shaft.

3. The EGR coolant control system of claim 1, wherein the pressure supply pipe is connected with an intake manifold and receives back pressure of the intake manifold.

4. The EGR coolant control system of claim 1, wherein the pressure supply pipe is connected with an exhaust manifold and receives back pressure of the exhaust manifold.

5. The EGR coolant control system of claim 1, wherein the pressure supply pipe is connected with an input portion of the coolant supply pipe and receives a partial pressure applied to the coolant supply pipe.

* * * * *